United States Patent [19]

Skyttä et al.

[11] Patent Number: 4,559,106

[45] Date of Patent: Dec. 17, 1985

[54] PRESS ROLL AND PRESS IN A PAPER MAKING MACHINE

[75] Inventors: Osmo Skyttä, Jyväskylä; Väinö Sailas, Vaajakoski, both of Finland

[73] Assignee: Valmet OY, Finland

[21] Appl. No.: 608,231

[22] Filed: May 8, 1984

[30] Foreign Application Priority Data

May 12, 1983 [FI] Finland ..... 831670

[51] Int. Cl.[4] ..... D21F 3/02; D21F 3/08

[52] U.S. Cl. ..... 162/358; 29/121.1; 29/130; 100/121; 162/205; 162/305

[58] Field of Search ..... 162/358, 205, 305, 361; 29/113 R, 113 AD, 130, 131, 132, 121.1; 100/121, 176, 155

[56] References Cited

U.S. PATENT DOCUMENTS

| | | | |
|---|---|---|---|
| 2,723,931 | 11/1955 | Mercer | 29/130 |
| 2,997,406 | 8/1961 | Freeman et al. | 29/130 |
| 3,364,103 | 1/1968 | Kusters | 162/358 |
| 3,804,707 | 4/1974 | Mohr et al. | 162/358 |
| 4,366,025 | 12/1982 | Gordon, Jr. et al. | 162/358 |
| 4,368,568 | 1/1983 | Watanabe | 29/130 |

FOREIGN PATENT DOCUMENTS

| | | | |
|---|---|---|---|
| 1938604 | 10/1977 | Fed. Rep. of Germany | 29/121.1 |
| 2049102 | 12/1980 | United Kingdom | 29/130 |

*Primary Examiner*—S. Leon Bashore
*Assistant Examiner*—K. M. Hastings
*Attorney, Agent, or Firm*—Steinberg & Raskin

[57] ABSTRACT

A press roll in a paper making machine comprises a non-perforated inner frame onto which an elastic layered structure is applied, the layered structure including an inner layer having a volume of which a substantial portion is constituted by cavities and an outer layer adapted to act against the inner surface of a looped press felt which passes through the press nip, the outer layer having passages formed therethrough which communicate with the cavities of the inner layer. During operation, the cavities are compressed together and thereby widen or extend the nip zone and, additionally, the cavities act as suction devices to produce a negative pressure in the nip zone following the centerline thereof. A press is disclosed which is formed by the press roll described above and a counter-roll which is provided with an elastic coating and a hollow face. A pair of press felts pass through the nip zone formed by these rolls between which the web to be dewatered is passed.

10 Claims, 3 Drawing Figures

PRESS ROLL AND PRESS IN A PAPER MAKING MACHINE

BACKGROUND OF THE INVENTION

This invention relates generally to paper making machines and, more particularly, to press rolls and presses formed thereby.

The most common conventional method for removing water from paper and cardboard webs is to pass the web through a press nip formed by a pair of rolls situated opposite one another. It is also conventional to pass one or two press fabrics through the dewatering press nip, the fabrics carrying the water removed from the web and, moreover, carrying the web onwards.

As the rates of production of paper machines have increased, the web dewatering performed by press nip dewatering methods has become a factor limiting further increases in production rates due to the fact that the press nips formed by a pair of conventional press rolls are relatively short or narrow. It therefore follows that at high production speeds the web remains in such press nips for only a relatively short time. On the other hand, since the fibrous structure of the web inherently results in a certain flow resistance, the water in the web requires a certain amount of time to be able to escape from the web into the hollow face of a press roll and/or into a press fabric.

Attempts have been made to increase the dewatering output in nip presses by increasing the nip pressure. However, it has been found that at a certain line pressure a limit is reached beyond which further increases in the nip pressure are no longer practical because the structure of the web can no longer withstand the high compression forces.

It is also possible to increase the area of a press nip formed by a pair of rolls by using rolls having relatively large diameters and/or by passing relatively soft press fabrics through the nip. However, a limit is eventually reached in even these arrangements beyond which any increase in dewatering becomes uneconomical.

Presses are also known in the art which consist of a pair as rolls having resilient coatings such, for example, of rubber or polyurethane, for the purpose of extending or widening the nip area. For example, reference is made to U.S. Pat. No. 3,535,760 which discloses a press which includes a roll having an elastic coating. It is also known to provide rolls having elastic coatings with various groove formations in order to increase their elasticity. In this connection, reference is made to U.S. Pat. No. 3,630,837.

It is also known in the art to pass a resilient mat through a nip in order to lengthen or widen the press nip.

A serious drawback of presses having a construction as described above wherein a resilient or elastic roll or pair of rolls or a resilient mat are utilized is that a so-called "rewetting" phenomenon occurs when a web is passed through such a press. Indeed, rewetting occurs even in the case of dewatering a web in a conventional nip press. For example, a web will be situated for about 20 ms within an area of the mid-portion of a press nip in which the compression pressure has been reduced to a level which is below a certain limit. Despite the relatively short duration of time during which the web is present in this region of the press nip, a rewetting of about 30% will occur. This phenomenon represents a fundamental drawback of conventional press nips which has limited the dewatering capacity even of nips provided with relatively wide press zones.

SUMMARY OF THE INVENTION

Accordingly, it is an object of the present invention to provide a new and improved press roll and press including the same which avoids the drawbacks of conventional press rolls and presses as described above.

Another object of the present invention is to provide a press roll and press having an extended press zone in which a rewetting of the web will not occur or in which rewetting is substantially reduced.

Still another object of the present invention is to provide a new and improved press roll and press incorporating the same having a construction which is simpler and more economical relative to conventional press suction rolls which are provided with a perforated mantle and with an internal suction chamber.

Briefly, in accordance with the present invention these and other objects are attained by providing a press roll including an inner frame to the outer surface of which an elastic layered structure is applied, the layered structure including an inner layer whose volume is substantially constituted by open spaces, such as cavities or the like, and an outer layer adapted to act against an inner surface of a loop press felt which passes through the nip zone and in which passage means are formed which open into the open spaces of the inner layer. Such construction overcomes the disadvantages of conventional press rolls as described above in that during operation the open spaces in the inner layer of the layered structure are compressed together within the press nip zone to thereby widen the press nip zone. Moreover, the open spaces act as suction means for producing a negative pressure in a region downstream of the center line of the press nip zone.

Thus, not only is the zone of the press nip effectively widened or enlarged to increase the time spent by the web in the press nip zone to thereby increase dewatering but, additionally, by virtue of the negative pressure produced by the suction provided by the open spaces as they expand after passing the center line of the nip zone, the rewetting of the web is at least substantially eliminated.

According to the invention, the press is formed by the press roll described above and a second, counter-roll which itself is provided with an elastic coating and which has a hollow face. A pair of press felts are passed through the nip zone formed by the rolls. The web being dewatered is situated between the press felts as the same passes through the nip zone.

The press roll in accordance with the invention is economic in construction and can be provided with a frame construction which is at least as durable as that of a perforated suction roll. The elastic inner layer of the layered structure advantageously provides both a sufficiently long or wide nip zone as well as a pumping effect which results in the advantages described above and which are described in greater detail below.

DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
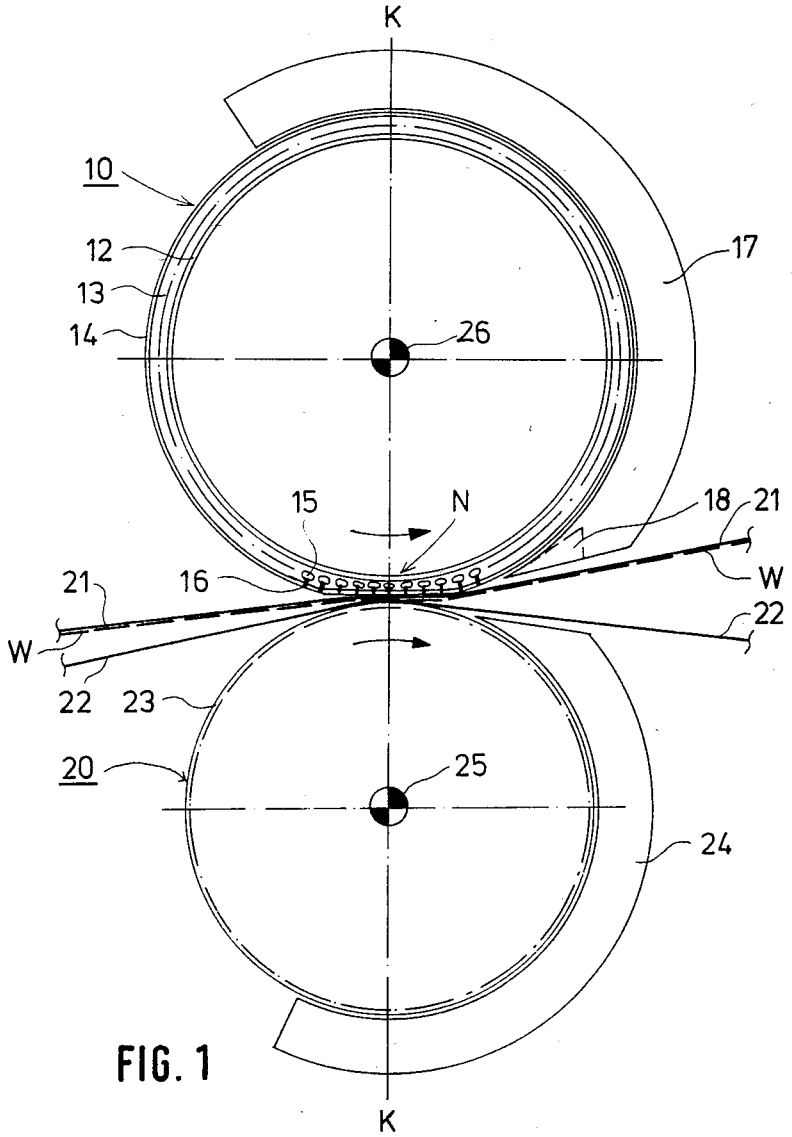
FIG. 1 is a schematic side elevation view of a dewatering press of a paper machine in accordance with the present invention, the dewatering press including as its upper roll a hollow roll constructed in accordance with the invention provided with an elastic layered structure.

Referring now to the drawings wherein like reference characters designate identical or corresponding parts throughout the several views and, more particularly, to FIG. 1, a dewatering press of a paper making machine in accordance with the invention by means of which a web W is dewatered as it passes through a press nip N is illustrated. The press nip N is formed between an upper roll 10 constructed in accordance with the invention and a lower roll 20, each roll being provided with its own drive, designated 26 and 25 respectively. The web W is carried into the press nip on the lower surface of a press felt 21 and passes between the press felt 21 and a second press felt 22 as it travels through the press nip zone. The web W leaves the nip zone supported on the same felt 21 as when it entered into the press nip. The lower roll 20 is a press roll provided with a hollow face such, for example, as a grooved face 23 produced by winding a profiled band around a cylindrical frame. Water collecting troughs 17 and 24 are situated over both rolls 10 and 20 at the outlet side of the nip N. The wedge portion 18 of the water collecting trough 17 extends as deeply as possible into the wedge-shaped space defined between the press felt 21 and the upper roll 10.

Figure 2:
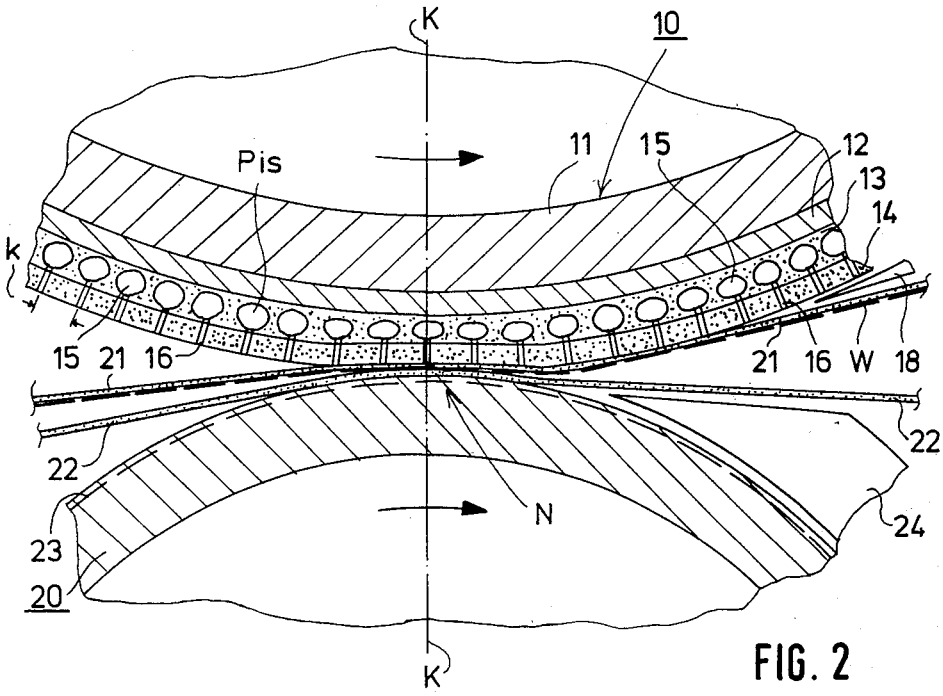
FIG. 2 is a partial side elevation view of the press nip illustrated in FIG. 1 on an enlarged scale.

Referring now to FIG. 2, a preferred embodiment of a press roll constituting press roll 10 constructed in accordance with the present invention is illustrated. The roll 10 includes a substantially cylindrical inner frame or mantle 11 formed of any suitable material such, for example, as cast iron or steel. A layer 12 is applied on the outer surface of the inner frame 11 which functions both as a fastening as well as a corrosion inhibiting layer. Layer 12 comprises a solid layer, i.e., no holes or perforations pass through layer 12, and may be formed of rubber. Alternatively, the layer 12 may be formed of acid-proof steel sheet material, a plastomer material, an elastomer material or any other equivalent material which will adhere to the frame or mantle 11. The layer 12 is preferably formed of a hard material so that heat generating deformations will not be formed to any substantial extent. It is also possible to use as the layer 12 a sprayed corrosion-proof coating, preferably having a porous outer face.

An important feature of the present invention is that an elastic layered structure is applied around the outer surface of the frame 11 and, in accordance with the illustrated embodiment, the elastic layered structure is applied over the layer 12. The layered structure includes an elastic compressible inner layer 13 through a substantial portion of the volume of which open spaces in the form of cavities 15 are formed. Each cavity 15 may, for example, have a substantially cylindrical shape which extends over substantially the entire axial length of the roll 10. Alternatively, cavities 15 may be shorter than the axial length of the roll 10 with two or more cavities being axially aligned over the axial length of the roll. Moreover, the cavities 15 may have a shape other than cylindrical, such as spherical or the like and indeed may be constituted by pores within the elastic compressible layer 13. The elastic material of which layer 13 is formed must be quite durable since the layer 13 is subjected to relatively high loads in the nip N. For example, if the line pressure in the nip N is on the order of about 80 kn/m, a peak pressure of about 60 bars will prevail in the nip, this peak pressure being designated $P_1$ in FIG. 3. The compressibility of the layer 13 is, however, essentially achieved through the presence of the open spaces, i.e., the cavities 15 or corresponding spaces, throughout its volume since a compressible gas, usually air, is present in the open spaces.

An outer layer 14 is situated over the inner layer 13 in accordance with the invention. The outer or surface layer 14 acts as the principal working layer since it is adapted to act against the felt 21 in the nip N. The surface layer 14 is constructed, for example, of relatively hard plastic material, an appropriate rubber mixture, or the like. According to the invention, passages or perforations are provided through the surface or outer layer 14 which are substantially similar to the perforations provided in a suction roll. The passages 16 are spaced from each other by appropriate distances and open into and communicate with the cavities 15. If the cavities 15 have a spherical shape and the diameter of each spherical cavity is somewhat shorter than the radial thickness of the inner layer 13, at least one passage 16 opens into each cavity 15. On the other hand, where the cavities 15 are constituted by elongated cylindrical spaces, several passages 16 open into the same cavity 15. Axially adjacent passages 16 are preferably spaced from each other a distance which is substantially equal to the spacing k between circumferentially adjacent passages 16 (FIG. 2). Thus, each passage 16 comprises a discrete conduit which passes through the outer layer 14 spaced by a distance k from axially and circumferentially adjacent passages and, as seen in the drawings, opens into a cavity 15 having a larger volume than the passage.

By virtue of the provision of the layered structure on the roll 10 in accordance with the invention, the extension $L_1$ of the nip N (FIG. 3) in the direction of travel of the web W is increased and, therefore, the duration of time during which the web W remains in the press nip zone is sufficiently long that the web is efficiently dewatered to such an extent that at least in some cases only a single nip N may be sufficient for the entire paper machine. In such a case, the felts 21 and 22 must be chosen so that their dewatering capacity is sufficient to accommodate relatively large amounts of water pressed from the web W.

The significant widening of the press nip zone to a length $L_1$ as described above is only one of the important advantages obtained by the present invention. An equally important or even more important property of the layered structure of roll 10 is that when the cavities 15 are compressed within the zone of the press nip, the cavities act in a pump-like manner. More particularly, referring to FIG. 3, the press nip zone extends between an initial boundary line $E_1$ and a boundary end line $E_2$. Starting from the initial boundary line $E_1$ of the nip zone $L_1$, the nip or compression pressure $P_{is}$ acting upon the web W rises in accordance with the curve A reaching its maximum $P_1$ at the centerline K—K of the nip N. The cavities 15 are compressed together under the influence of the compression pressure $P_{is}$ within the nip zone $L_1$ whereupon at least some air is expelled from the cavities into the felt 21. Accordingly, a positive pressure is generated in the cavities 15 as shown by the curve designated B in FIG. 3. The positive pressure condition in cavities 15 extends over a portion of the nip zone $L_1$, that portion being designated $L_2$. It is thus noted that the positive pressure zone $L_2$ of cavities 15 terminates somewhat prior to or upstream of the boundary end line $E_2$ of the press nip zone $L_1$ whereupon a negative pressure is created within the cavities 15 as designated by the shaded area C in FIG. 3. The negative pressure condition extends over a region $L_3$ so that negative pressure having a magnitude designated by the curve D exists in the web carrying felt 21 on both sides of the boundary end line $E_2$ of the press nip zone $L_1$. Thus, under the pumping effect of cavities 15, a suction effect is produced by means of which a substantial portion if not all of the detrimental rewetting of the web W is prevented. Furthermore, under the action of the negative pressure (curve D) prevailing within the zone $L_3$, the reliability of the web W following the upper felt 21 after the press nip zone is increased without the possibility of water returning into the web W, at least to the same extent as in prior art presses. It can thus be stated that under these circumstances the effect of the negative pressure within the zone $L_3$ is the promotion of an efficient opening of the nip.

Suction devices or the like are preferably provided proximate to the sector of the roll 10 that is free from the web W. By means of such suction devices the water which may be carried in the passages 16 and possibly in the cavities 15 is removed therefrom and the elastic coating of the roll is cleaned. Such suction devices and/or other corresponding devices are conventional.

The layered structure 13, 14 is heated to at least some extent due to the deformation which occurs in the nip zone. Therefore, cooling devices may be provided over the free sector of the roll 10, such as blowing or water-spraying arrangements, by means of which the coating of roll 10 is cooled and possibly cleaned at the same time.

A roll in accordance with the invention can be made sufficiently mechanically strong with an inner frame 11 having a relatively thin wall such, for example, as compared to a corresponding suction roll, since the inner frame 11 can be solid, i.e., free of perforations, which would materially reduce the strength of the roll. The outer surface of the inner frame or mantle 11 may be provided with grooves in order to promote the adherence of the layered structure to the inner frame.

Figure 3:
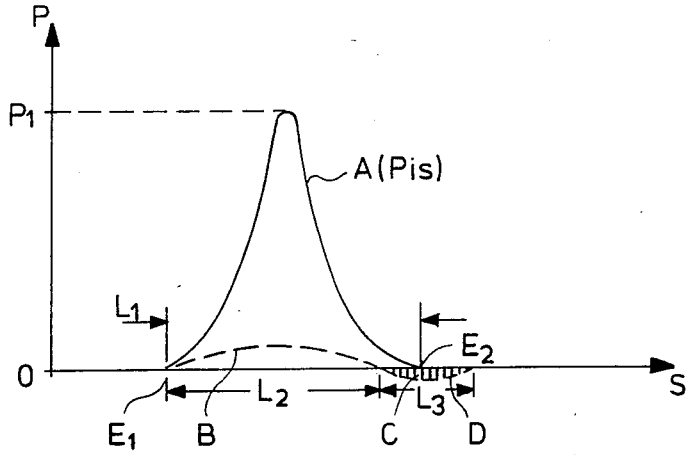
FIG. 3 is a graphical illustration of the pressure distribution of the pressing pressure in the nip in addition to the pressure distribution of the pressure in the open spaces or cavities in the elastic inner layer of the layered structure of the upper roll of the press as a function of the location within the press nip zone.

It is seen from the foregoing that it is an essential feature of the layered structure in accordance with the invention that the positive pressure that prevails in the cavities 15 in accordance with curve B of FIG. 3 is converted to a negative pressure (curve D) after the nip pressure $P_{is}$ is reduced below a certain value but at a point somewhat before the nip pressure $P_{is}$ acting on the web W within the nip press zone is reduced to zero at the boundary end line $E_2$ of the nip zone. In this manner a negative pressure effect is produced at both sides of the boundary end line $E_2$ of the press nip zone $L_1$ due to the expansion of the cavities 15 having the favorable properties and effects described above.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a paper making machine, a press roll adapted to form together with another roll a press nip having a press nip zone, comprising:

an inner frame having an outer substantially cylindrical surface; and an elastic layered structure applied entirely around and adhering to said outer surface of said frame, said layered structure including an elastic inner layer having a plurality of cavities formed therein, and an outer layer having a plurality of discrete passages formed therethrough, at least one passage communicating with each of said cavities, the volume of a passage being smaller than the volume of a respective cavity with which it is in communication;

said cavities and passages being constructed such that during operation said cavities are compressed together within the press nip zone to thereby widen the press nip zone and such that said cavities produce a negative pressure in the press nip zone following a central region of the press nip zone.

2. The combination of claim 1 further including an additional layer situated between said outer surface of said frame and said inner layer, said additional layer being formed of a material which adheres to said frame.

3. The combination of claim 1 further including an additional layer situated between said outer surface of said frame and said inner layer, said additional layer being formed of a material which is corrosion resistant.

4. The combination of claim 3 wherein the material of which said additional layer is formed adheres to said frame.

5. The combination of claim 3 wherein said material of which said additional layer is formed is selected from the group consisting of rubber, elastomer, plastomer, acid-proof steel sheet material and a coating sprayed onto the outer surface of said frame.

6. The combination of claim 1 wherein said plurality of cavities comprise a plurality of substantially cylindrical cavities extending longitudinally in a direction substantially parallel to the axis of said press roll.

7. The combination of claim 6 wherein the spacing between adjacent passages is substantially equal in the axial and circumferential directions of the press roll.

8. The combination of claim 1 wherein the spacing between adjacent passages is substantially equal in the axial and circumferential directions of the press roll.

9. In a paper making machine, a press forming a press nip defining a press nip zone through which a web to be dewatered passes during operation of the paper making machine, comprising:

a first press roll including an inner frame having an outer substantially cylindrical surface, an elastic layered structure applied entirely around and adhering to said outer surface of said frame, said layered structure including an elastic inner layer having a plurality of cavities formed therein, and an outer layer acting against an inner surface of a looped press felt passing through the press nip, said outer layer having a plurality of discrete passages formed therethrough, at least one passage communicating with each of said cavities, the volume of a passage being smaller than the volume of a respective cavity with which it is in communication;

a second press roll in nip defining relationship with said first press roll forming a press nip zone therebetween, said second press coil having an elastic coating and a hollow face; and a pair of press felts passing through said press nip zone, said cavities and passages being constructed such that during operation said cavities are compressed together within the press nip zone to thereby widen the press nip zone and such that said cavities produce a negative pressure in the press nip zone following a central region of the press nip zone.

10. The combination of claim 9 wherein said first and second press rolls comprise upper and lower rolls respectively and said pair of felts include upper and lower felts.

* * * * *